United States Patent [19]

Schad et al.

[11] 3,948,592

[45] Apr. 6, 1976

[54] SPINNING UNIT FOR MELT SPINNING HIGH POLYMERS

[75] Inventors: Walter Schad, Rommerz; Walter Blomeyer, Wolfgang, both of Germany

[73] Assignee: Zimmer Aktiengesellschaft, Germany

[22] Filed: June 18, 1974

[21] Appl. No.: 480,521

[30] Foreign Application Priority Data

June 22, 1973 Germany ..... 2331764

[52] U.S. Cl. ..... 425/192 S; 425/382.2

[51] Int. Cl.[2] ..... B29F 3/06

[58] Field of Search ..... 425/382.2, 192, 192 S; 29/256

[56] References Cited

UNITED STATES PATENTS 2,226,078 12/1940 Spahn ..... 29/256 UX 3,655,314 4/1972 Lenk et al. ..... 425/382.2 X

*Primary Examiner*—R. Spencer Annear

*Attorney, Agent, or Firm*—Allegretti, Newitt, Witcoff & McAndrews

[57] ABSTRACT

A spinning unit for spinning fiber-forming polymers having a high pressure pump mounted on a pump base, and an interconnecting nozzle unit disposed adjacent said pump base within an insulated housing. A draw spindle threaded at one end and having a shoulder spaced from the threaded end, secures the pump base to the nozzle unit, the latter having a threaded opening to receive the threaded end of the spindle, the pump base having a wall against which said shoulder abuts to put the spindle in tension as it is tightened into said threaded opening.

3 Claims, 2 Drawing Figures

SPINNING UNIT FOR MELT SPINNING HIGH POLYMERS

BACKGROUND OF THE INVENTION

The invention relates to a spinning unit, particularly for the melt spinning of high polymers, such as polyesters, polypropylene and polyamides, comprising a spinning pump mounted on a pump base and nozzle unit, secured within a housing provided with a heating jacket, the pump base being connected by means of a screw connection to the nozzle unit.

Systems already known include spinning units of the kind mentioned above, in which the nozzle unit and the pump base are screwed together by means of a pressure spindle situated, opposite the sealing surface, in the nozzle housing (Ger. Fin. Discl. 1,660,209). In a construction of this kind the nozzle housing has to take up the reaction forces of the pressure applied and, as it were, "guide them around" the nozzle unit. Heavy constructions are therefore required, rendered still bulkier, for example, by the installation of profile bars. In view of the complicated nature of the spinning units now customary, the necessary reinforcement devices cannot always be attached in the desired manner. Apart from this, an increasing quantity of steel is required, the volume of space available for the heating agent being reduced accordingly. This results in difficulties from the thermal point of view.

In addition, there is a tendency to use increasingly large spindle nozzle plates, of correspondingly ample width, the problems of rigidity thus being aggravated. In this connection it must be borne in mind that the usual spinning pressures are in the range of 500–1000 atm. gauge pressure. This pressure tends to separate nozzle unit and pump base by a force which is the product of pressure and cross-section of connecting ducts. The spindle furthermore has to supply the sealing force which prevents the polymer melt from escaping from between the contact surfaces.

Above all, however, the position and number of the threads in the pressure screws provided in the housing are fixed by the housing, so that changes in the number of nozzle units within the spinning units and the number of conduits for the spinning melt cannot be altered later.

SUMMARY OF THE INVENTION

The purpose of the invention is therefore to improve a spinning unit of the kind first described above in such a way that the reaction forces of the screw connection are not transmitted through the housing, while at the same time, without any alterations to the housing or to the spinning beam, the apparatus can be modified with different nozzle units and with different numbers of screw connections.

The invention enables the above object, in the spinning unit of the kind first described above to be achieved by a system in which the screw connection used consists of at least one draw spindle mounted directly in the nozzle unit and in the pump base. A counter-thread for the draw spindle is provided, either in the nozzle unit or in the pump base, while a shoulder on the spindle abuts against a stop in the other unit (the pump base or the nozzle unit, respectively). The path of forces between the base and the unit is thus made as short as possible, and the housing structure is not interposed therebetween for transmission of the forces.

Since the draw spindle is mounted in the pump base and the latter is usually removed and replaced at the same time as the nozzle unit, the system offers the additional advantage that the stop for the screw connector, and the connector itself, can in each case be removed and replaced together, without any alteration to the housing. The spinning unit is thus universally usable.

A further development of the invention provides the particular advantage that the counter-thread for the draw spindle is provided in the nozzle unit while the stop or abutment for the draw spindle is provided in the pump base. In this case, the spinning pump and its drive shaft and also the draw spindle are situated on one and the same side of the pump base, i.e., on the side facing away from the nozzle unit, so that the spinning pump and the draw spindle, in the dismantling operation, can be detached and removed from the same side of the spinning housing. This enables spinning units to be arranged back-to-back within a very limited space. For this reason, the spinning pump, pump base and draw spindle are preferably combined to form a unitary, structural assembly and designed so that they can be removed together from the spinning unit.

DESCRIPTION OF THE DRAWINGS

Examples of the object of the invention will be described below in detail, by reference to FIGS. 1 and 2.

The diagrams are as follows.

DETAILED DESCRIPTION

Figure 1:
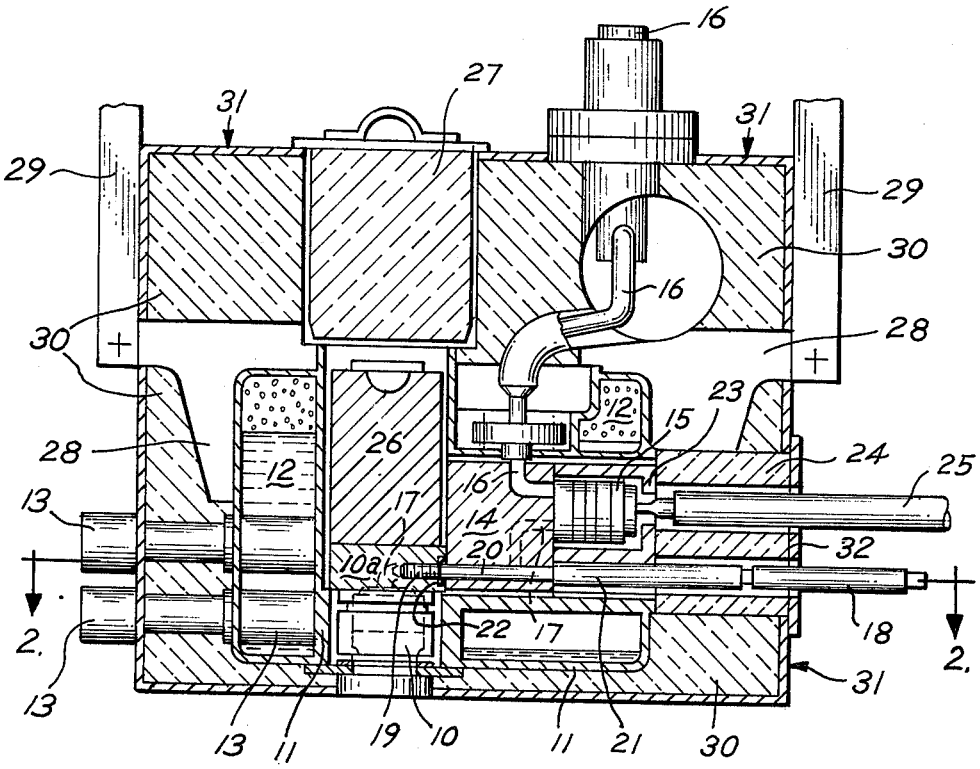
FIG. 1 is a vertical section through a complete spinning unit.

FIG. 1 contains a nozzle unit 10 which consists, in the conventional manner, of a housing with filter inserts and a nozzle plate. Details of the nozzle unit are known in the prior art and therefore need not be discussed in detail. The nozzle unit 10 is situated inside a spinning housing 11 containing a series of hollow spaces 12 accommodating a heating agent such as a mixture of diphenyl and diphenyl-oxide. The heating bodies consist of electrical heating cartridges 13 of which the heated part extends transversely through the spinning unit.

The housing 11 has an aperture in a side wall through which is inserted a pump base 14 structurally connected to pump 15 for the production of the spinning pressure. The pump 15 is supplied with the spinning melt via a conduit 16 part of which takes its course inside the essentially massive pump base 14. An outlet conduit 17 leads from the pump 15 through the pump base 14 into the nozzle unit 10. Nozzle unit 10 possesses an essentially massive upper base **10*a* which contacts pump base 14. The contact surfaces between the nozzle unit 10 resp. the base 10*a* and the pump base 14 are constructed as sealing surfaces, the necessary sealing force being obtained by a screw connection utilizing a draw spindle 18. The draw spindle 18 has one end 20 of reduced diameter provided with screw threads 19. The draw spindle 18 includes shank 21 of larger cross-section provides a shoulder at the point of reduced diameter which abuts against a stop in the pump base 14. When the draw spindle 18 is tightened up, it draws the nozzle unit 10, by means of the counter-thread provided in the latter, against the pump base 14. The sealing effect is obtained by a sealing disc 22,** in line 17.

The pump 15 and the spindle shank 21 are disposed within an integral filling block 23 made of aluminum, covered on the outside by an insulation filling piece 24. Teh filling block 23 is positioned adjacent pump base 14. The torque to drive the pump 15 is transmitted by a drive shaft 25 from a motor, not shown in the drawing. It may be seen that the pump base 14, together with the pump 15 and the draw spindle 18, can be withdrawn through the opening in the wall of the spinning unit, towards the right, (FIG. 1) after the conduits 16, 17 and the draw spindle 18 have been released. The filling block 23 and also the insulation filling piece 24 are removed at the same time.

A filling piece 26 made of aluminum, and filling that part of the housing 11 which is situated above the nozzle unit 10, rests on the base 10*a*. The filling piece 26 is covered by a block of insulation 27 also constituting the external closure, with a heat insulating effect, of the spinning unit. After the release of the draw spindle 18 and its removal from the spinning unit the nozzle unit 10 can be withdrawn from the top of the housing 11. As the counter-thread for the draw spindle 18 is situated in a wall of the nozzle unit 10, the removal and replacement of the latter is accompanied by that of the screw threads for the draw spindle. The resulting possible variations in the devices with which the spinning unit can be equipped will be explained in detail further on, by reference to FIG. 2.

The wall of the housing 11 surrounding the hollow spaces 12 forms a heating jacket. Suspension lugs 28, by which the housing 11 can be affixed to a suspension 29, are provided on both sides of the housing. The housing 11 is surrounded on all sides by a spinning beam insulation 30 which is provided on its outer surface with an insulation lining 31. The insulation lining 31 is closed by means of a cover plate 32 at the opening in the housing where the drive shaft 25 and the draw spindle 18 are removed from the spinning unit.

Figure 2:
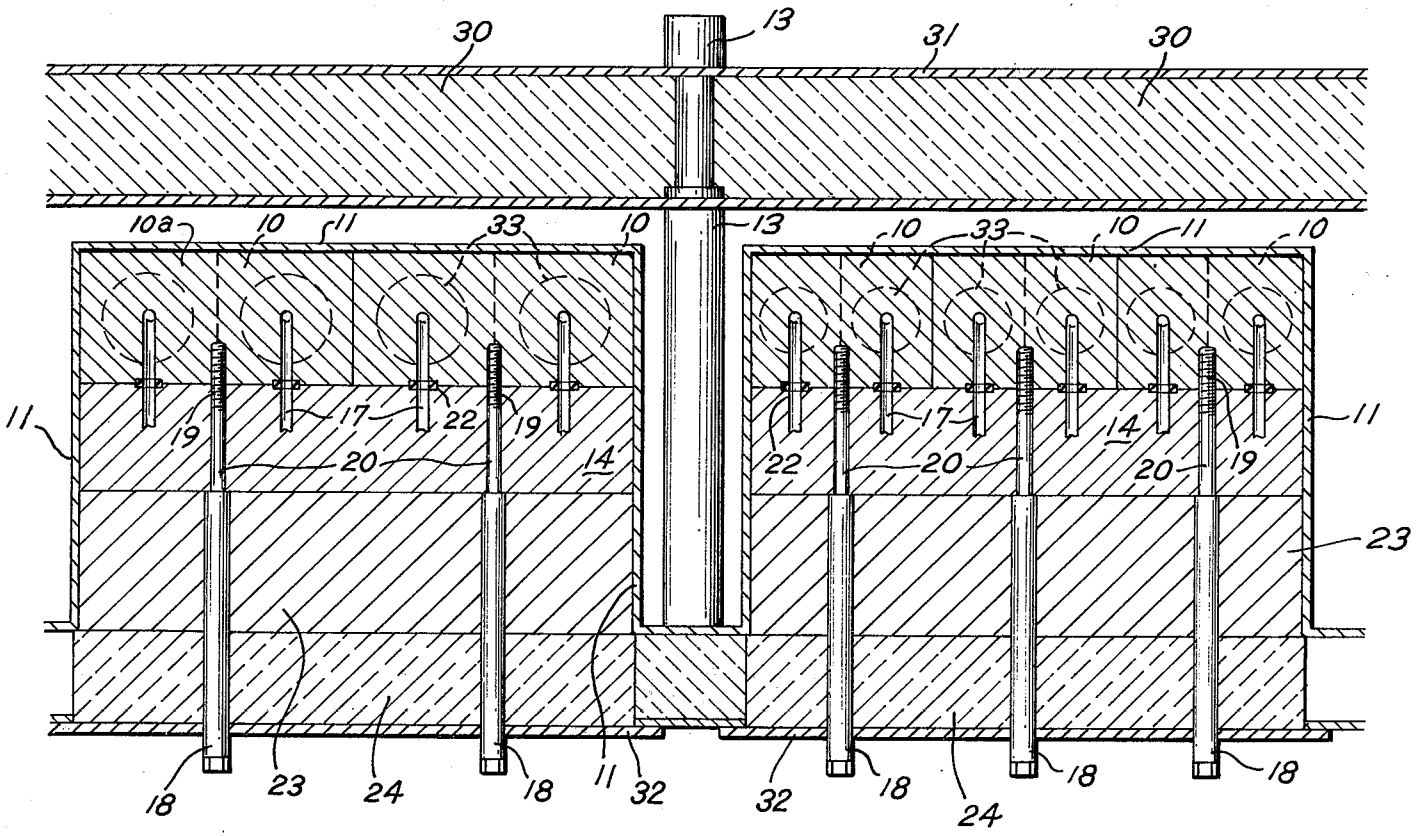
FIG. 2 is a horizontal section along the line II—II through the apparatus shown in FIG. 1.

In FIG. 2 the parts have the same numbers as the corresponding components in FIG. 1, so that they need not be repeated. In the left-hand half of FIG. 2 the spinning unit is equipped with two nozzle units 10, each of which is provided with two spinning nozzle plates 33, with the corresponding number of outlet conduits 17. These items are arranged symmetrically, the counter-thread for the draw spindle 18 and the thread 19 of the latter being situated in the plane of symmetry of each nozzle unit 10. It can be seen that the path of the force provided by the draw spindle 18 is made as short as possible and, in particular, that no forces are transmitted through the housing 11.

From the right-hand half of FIG. 2 it may be seen that the arrangement shown in the left-hand half of FIG. 2 can be replaced by three nozzle units 10 with which spinning nozzle plates 13 are again arranged in symmetrical pairs. Here again, a counter-thread for the draw spindle 18 is provided in the plane of symmetry between the outlet conduits 17. In this case the spinning unit is equipped with six spinning nozzle plates 33, the three corresponding nozzle units 10 being pressed against the pump base 14 by the three draw spindles 18. It can once again be seen that with the use of the draw spindles according to the invention no alterations to the housing 11 are required if the number and dimensions of the spinning nozzle plates 13 or of the nozzle units 10 are to be changed. In any re-tooling, all that is required is to remove and replace the parts described in conjunction with FIG. 1.

What we claim is:

1. An improved Spinning unit, particularly for the melt spinning of high polymers, such as polyesters, polypropylene and polyamides, comprising a spinning pump mounted on a pump base and a nozzle unit, disposed within a housing and adapted to be pressed against the pump base by means of a horizontal screw connection means which is independent of the housing, characterized by the fact that the screw connection means comprises: at least one threaded draw spindle which has a threaded portion adjacent to one of its ends and which includes a shoulder that is spaced from the one end and that is adapted to abut against the nozzle unit or the pump base; and a counter-thread portion situated in the pump base or the nozzle unit; the draw spindle permeating the nozzle unit and the pump base and having its threaded portion adapted to be threadedly interconnected with the counter-thread portion by rotation of the draw spindle about its longitudinal axis; the nozzle unit and the pump base being drawn and pressed together by and between the shoulder and the interconnection of the thread and counter-thread portions.

2. The Spinning unit in accordance with claim 1, characterized by the fact that the counter-thread portion of the screw connection means is situated in the nozzle unit and the shoulder of the draw spindle abuts against the pump base.

3. The spinning unit in accordance with claim 1, characterized by the fact that the spinning pump, the pump base and the draw spindle are combined to form a unitary assembly which can be withdrawn from the spinning unit, together with insulation and a filling block that are disposed between the pump and the housing.

* * * * *